US006904983B2

(12) United States Patent
Thigpen et al.

(10) Patent No.: US 6,904,983 B2
(45) Date of Patent: Jun. 14, 2005

(54) LOW-CONTACT AREA CUTTING ELEMENT

(75) Inventors: Gary M. Thigpen, Kingwood, TX (US); Carl W. Keith, Houston, TX (US); Bruno Cuillier, Pau (FR)

(73) Assignee: Varel International, Ltd., Carrollton, TX (US)

( * ) Notice: Subject to any disclaimer, the term of this patent is extended or adjusted under 35 U.S.C. 154(b) by 24 days.

(21) Appl. No.: 10/355,674

(22) Filed: Jan. 30, 2003

(65) Prior Publication Data

US 2004/0149495 A1 Aug. 5, 2004

(51) Int. Cl.[7] ..... E21B 10/52
(52) U.S. Cl. ..... 175/428; 175/430; 175/434
(58) Field of Search ..... 175/426, 428, 175/430, 434

(56) References Cited

U.S. PATENT DOCUMENTS

| | | | | |
|---|---|---|---|---|
| 3,542,142 A | | 11/1970 | Hasiba | 175/67 |
| 4,058,177 A | | 11/1977 | Langford, Jr. et al. | 175/374 |
| 4,200,159 A | | 4/1980 | Peschel et al. | 175/329 |
| 4,593,777 A | | 6/1986 | Barr | 175/379 |
| 4,660,659 A | | 4/1987 | Short, Jr. et al. | 175/329 |
| 4,679,639 A | | 7/1987 | Barr et al. | 175/329 |
| 4,984,642 A | | 1/1991 | Renard et al. | 175/329 |
| 4,989,578 A | | 2/1991 | Lebourg | 125/23.01 |
| 5,172,778 A | | 12/1992 | Tibbitts et al. | 175/420.1 |
| 5,333,699 A | | 8/1994 | Thigpen et al. | 175/431 |
| 5,667,028 A | | 9/1997 | Truax et al. | 175/428 |
| 5,722,499 A | | 3/1998 | Nguyen et al. | 175/431 |
| 5,746,280 A | * | 5/1998 | Scott et al. | 175/374 |
| 5,881,830 A | * | 3/1999 | Cooley | 175/428 |
| 5,967,249 A | * | 10/1999 | Butcher | 175/428 |
| 6,000,483 A | * | 12/1999 | Jurewicz et al. | 175/428 |
| 6,068,071 A | * | 5/2000 | Jurewicz | 175/432 |
| 6,068,072 A | | 5/2000 | Besson et al. | 175/432 |
| 6,176,333 B1 | * | 1/2001 | Doster | 175/428 |
| 6,202,770 B1 | * | 3/2001 | Jurewicz et al. | 175/428 |
| 6,290,008 B1 | * | 9/2001 | Portwood et al. | 175/426 |
| 6,488,106 B1 | | 12/2002 | Dourfaye | 175/428 |
| 6,510,910 B2 | * | 1/2003 | Eyre et al. | 175/430 |
| 6,604,588 B2 | * | 8/2003 | Eyre et al. | 175/374 |

FOREIGN PATENT DOCUMENTS

| | | | |
|---|---|---|---|
| GB | 2 031 047 A | 4/1980 | E21B/10/52 |

* cited by examiner

*Primary Examiner*—Heather Shackelford
*Assistant Examiner*—Shane Bomar
(74) *Attorney, Agent, or Firm*—Baker Botts L.L.P.

(57) ABSTRACT

A cutting element for a drag-type drill bit comprises a cutter body having a generally cylindrical base section adapted for snug-fitting engagement in a socket of a drill bit body. The cutter body is secured to the bit body by brazing or other conventional attachment techniques. The cutter body further has a generally cylindrical cutting section integral with the base section. The cutting section has at least one inclined surface extending from a top surface of the cutting section partially along the length of the generally cylindrical cutting section. The cutter body may comprise a sintered tungsten carbide and the top surface may comprise a layer of super hard material.

20 Claims, 4 Drawing Sheets

| | |
|---|---|
| δ = CUTTING BREAK ANGLE | Sc = CUT EDGE |
| Ph = HYDROSTATIC PRESSURE | Sm = WEAR FLAT |
| Wc = BACK RAKE ANGLE | Fc = HORIZONTAL FORCE |
| Wd = CLEARANCE ANGLE | Fn = NORMAL FORCE |
| h = CUTTING DEPTH | Fℓ = LATERAL FORCE |

LOW-CONTACT AREA CUTTING ELEMENT

TECHNICAL FIELD OF THE INVENTION

The present invention relates to cutting elements for drag-type drill bits for drilling bore holes into subterranean formations. More particularly, the invention relates to drill bits and cutting elements therefor producing improved cutting forces for removal of cuttings from the front of a cutting element.

BACKGROUND OF THE INVENTION

Cutting elements having a polycrystalline diamond top surface are being utilized as the cutting or work portions of drilling or boring tools. Such cutting elements have been used in applications for drilling bore holes in subterranean formations in the mining, construction, oil and gas exploration, and the oil and gas production industries. There are many and varied forms and shapes of cutting elements currently being utilized with drill bits. One of the common insert shapes utilizes a cylindrical base section for insertion into the drill opening or socket of a drill bit body, with the upper or protruding portion of the cutting element being generally cylindrical with a planar polycrystalline diamond top surface. Many various shapes for the generally cylindrical upper or protruding section are in use.

Commercially available drill bits are classified as either roller bits or drag-type bits. A fixed cutter element is used as a part of the drag-type drill bits and do not employ a cutting structure with moving parts, for example, a rolling cone bit. The fixed cutter elements generally include polycrystalline diamond compact (PDC), thermally stable polycrystalline (TSP), and natural diamond.

A drag-type drill bit typically includes a shank portion with a threaded connection for mating with a drilling motor or a drill string. This shank portion can include a pair of wrench flats, commonly referred to as "breaker slots", used to apply the appropriate torque to properly make up the threaded shank. In a typical application, the distal end of the drill bit is radially enlarged to form a drilling head. The face of the drilling head is generally round, but may also define a convex spherical surface, a planar surface, a spherical concave segment, or a conical surface. In any of these applications, the body includes a central bore open to the interior of the drill string. This central bore communicates with several fluid openings in the bit used to circulate fluids to the bit face. In typical drill bit construction, nozzles situated in each fluid opening control the direction and flow of drilling fluid.

Typically, the drilling head or bit body of a drag-type drill bit is made from a steel or a cast matrix provided with cutting elements having a layer of super-hard material. Prior art steel-bodied bits are machined from steel and typically have cutting elements that are press fit or brazed into pockets provided in the face of the bit body. Cutters are typically mounted in steel-bodied bits by brazing directly into the pockets provided in the bit face.

Cast matrix drill bits are conventionally manufactured by casting the matrix material in a mold configured to give a bit body the desired shape. Such matrixes can, for example, be formed of a copper-nickel alloy containing powdered tungsten carbide. Matrixes of this type are commercially available to the drilling industry. The cutting elements for the matrix bit body are typically formed from polycrystalline diamond compact (PDC) or thermally stable polycrystalline diamond (TSP) PDC cutter elements are brazed in an opening provided in the matrix body, while TSP cutters are cast within pockets provided in the matrix body.

The cutting action in prior art bits is primarily performed by the outer semi-circular portion of the cutting elements. As the drill bit is rotated and downwardly advanced by the drill string, the cutting edges of the cutter elements will cut a helical groove of generally semi-circular cross-sectional configuration into the face of the formation. When drilling bore holes into subterranean formations, conditions are often encountered where the drill bit passes readily through a comparatively soft formation and then strikes a significantly harder formation. Rarely do all the cutters on a conventional drag-type drill bit strike this harder formation at the same time. A substantial impact force is therefore incurred by the one or two cutters that initially strike the harder formation. The end result is high-impact load on cutter elements of the drill bit. Moreover, substantial wear or uneven destruction of the cutters initially striking the harder formation lessens the drill bit life.

The general theory of drag bit operation is to create tiny fractures as the cutting elements pass over the formation, thereby enabling drilling fluid to enter these fractures and remove the fractured portions of the formation. While most drag-type drill bits use this crushing or fracturing action to create a bore hole, some bits have been developed utilizing a shearing action to cut through the formation. Drill bits are generally designed to cut the earth formation to a desired three-dimensional profile which generally parallels the configuration of the operating end of the drill bit.

"Side rake", a term applied to the position of the cutting faces of a cutting element with respect to the bit body, is technically defined as the complement of the angle between (1) a giving cutter face and (2) a vector in the direction of motion of the cutting face while in use, the angle being measured in a plane tangential to the earth formation profile at the closest adjacent point. "Back rake", another term used to define the relative position of the cutting face of a cutting element with reference to the supporting bit body, is defined as the angle between (1) the cutting face of the cutting element; and (2) the normal to the earth formation profile at the closest adjacent point, measured in a plane containing the direction of motion of the cutting member, for example, a plane perpendicular to both the cutting face and the adjacent portion of the earth formation profile.

Proper selection of the back rake angle is particularly important for efficient drilling in a given type of earth formation. In soft formations, relatively small cutting forces may be used so that cutter element damage problems are minimized. However, in hard formations, significant back rake angles are utilized in order to avoid excessive wear in the form of breakage or chipping of the cutting elements due to the higher cutting forces.

SUMMARY OF THE INVENTION

In accordance with the present invention, there is provided a cutting element for a drag-type drill bit that comprises a cutter body having a base section adapted for snug fitting engagement in a socket of a drill bit body. The cutter body further comprises a cutting section integral with the base section, the cutting section having at least one inclined surface extending from a top surface of the cutting section partially along the length of the cutting section.

Further in accordance with the present invention, there is provided a cutting element for a drag-type drill bit that comprises a cutter body having a generally cylindrical base section adapted for snug fitting engagement in a socket of a drill bit body. The cutter body further comprises a generally cylindrical cutting section integral with the base section, the cutting section having a plurality of inclined surfaces extending from a top surface of the cutting section partially along the length of the generally cylindrical cutting section. A channel is formed in the top surface of the cutting section between adjacent inclined surfaces.

The force required to indent an earth formation with a cutting element of the present invention generates a normal force and a force required to remove cuttings from the front of the cutter element, thereby generating the cutting or drag force. A technical advantage of the present invention is that the normal force required for indentation of an earth formation with a cutting element of the present invention is about ten to twenty times lower than with a conventional round shaped cutting element penetrating into the earth formation for the same depth of cut.

It has long been a goal in the drilling of bore hole formations to increase the penetration rate of the drill bit by faster drilling for the same amount of weight placed on the drill bit. A further technical advantage of the present invention is that a cutting element in accordance with the present invention has a smaller area in contact with the rock formation, thereby resulting in a deeper penetration for the same amount of weight applied. Further, the shape of the diamond layer of the cutting element results in more diamond surface at the cutting tip than exists in conventional cutter elements. This results in a sharper pointed cutter element (with more diamond at the edge) that maintains good cutting structure at least as long as a less sharp rounded cutting element.

Another technical advantage of the present invention is achieved by placing more diamond material at the cutting edges which has an effect on the residual stress in the PDC layer. By use of a non-planar interface between the diamond layer and the carbide substrate, there is achieved a reduction in damaging residual stress. This enables a sharp, high concentration of diamond with a stronger supporting structure.

DETAILED DESCRIPTION OF THE INVENTION

The present invention comprises an improved low contact area cutting element providing a cutter combining both shearing and tensile action while drilling bore holes in earth formations.

Figure 2:
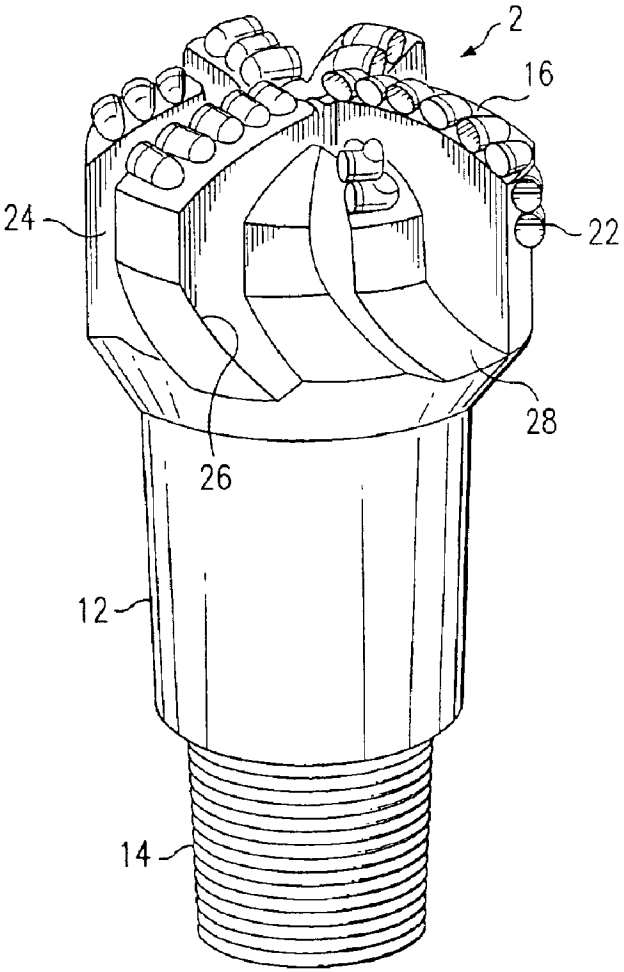
FIG. 2 illustrates a perspective view of the drill bit of FIG. 1.
Figure 1:
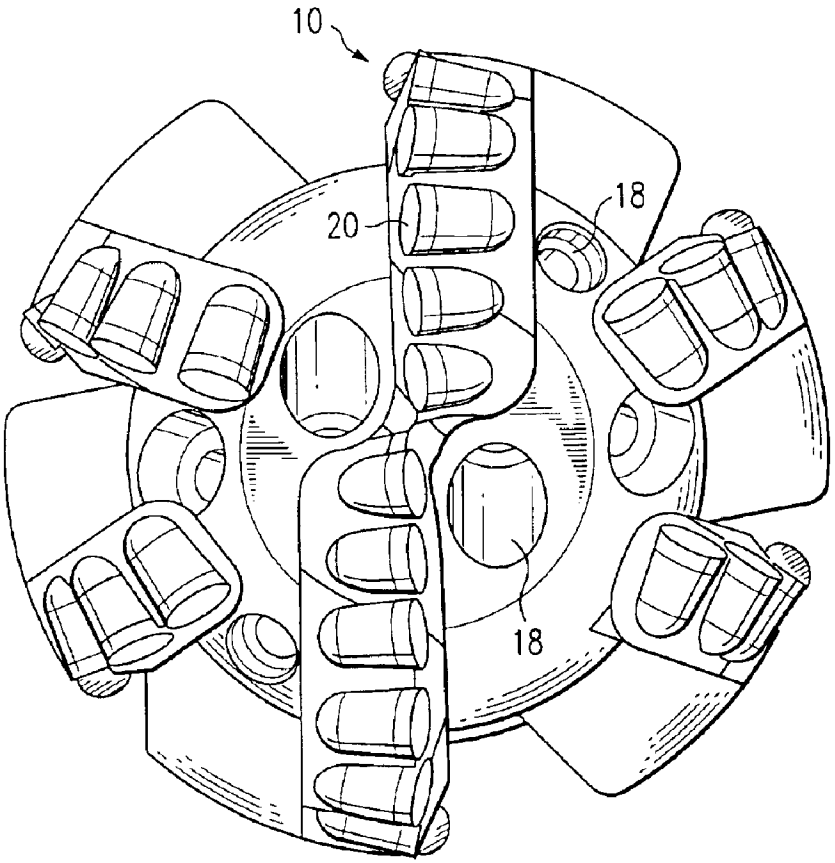
FIG. 1 illustrates a top view of a drill bit embodying the novel cutting elements of the present invention.

Referring to FIGS. 1 and 2, there is illustrated a drill bit 10 comprising at one end a shank 12 and a pin end 14 for connection to a drill string (not shown). Integral with the shank 12 at the end thereof opposite from the pin end 14, the drill bit defines a bit body 16. In the illustrated embodiment, bit body 16 has a substantially spherical segmented configuration although it is contemplated that the bit body 16 may have either a convex or concave bit face, or may alternately define a radial or conical surface. Opening through the bit face of the bit body 16 are a plurality of nozzles 18 extending through the bit body to a drilling mud passage within the shank 12. These nozzles enable drilling mud pumped through the drill string to be supplied to cutting elements 20 in accordance with conventional drilling techniques. In the embodiment of the drill bit 10 illustrated in FIGS. 1 and 2, there is provided gauging or reaming cutters 22 mounted to the sidewalls 24 extending from ribs or blades 26 radiating from the central area of the bit body and extending across the operating end face 16 to the side walls 24.

As illustrated, the radially extending blades 26 carry the cutting elements 20, to be described more fully below. The sidewalls 24 contact the walls of the bore hole which has been drilled by the operating end face of the bit body 16 to centralize and stabilize the bit and to help control drill bit vibrations. Typically, the reaming cutters 22 are angularly spaced, vertically aligned rows of PDC cutting elements provided on each sidewall 24. As illustrated, gauge pads 28 may also be part of the drill bit body 16 for additional stability.

Figure 3:
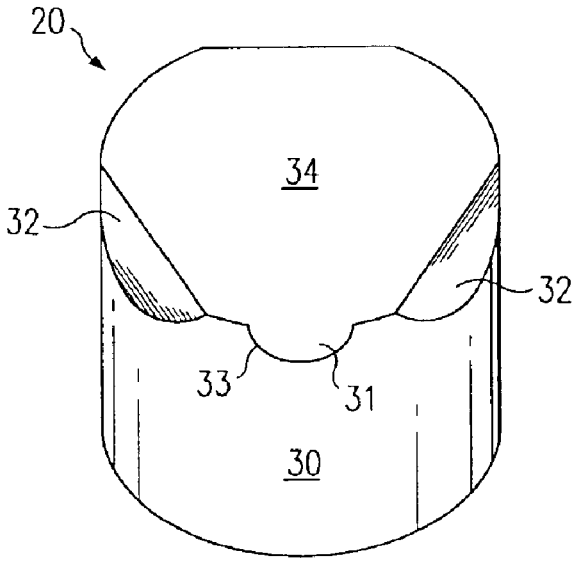
FIG. 3 is an elevated, pictorial view of a cutting element in accordance with the present invention for use with the drill bit of FIG. 1.

Referring to FIG. 3, there is illustrated one embodiment of a cutting element 20 in accordance with the present invention for use as a part of the drill bit 10 of FIG. 1. The cutting element 20 comprises a cutter body 30 having a substantially cylindrical configuration for that part secured into a socket of a rib or blade 26. As better illustrated in FIG. 4, the cutting element 20 comprises three beveled surfaces 32 extending from a top surface 34 of the cutter body and extending partially along the length of the cylindrical part of the cutter body 30. Integrally formed on the top surface of the cutter body 30 is a superabrasive cutting compact comprising a layer of super hard material. The cutting compact comprises a pattern of extending ribs 31 that engage a pattern of semi-circular grooves 33 in the top surface of the cutter body 30. The shape of the superabrasive cutting compact results in more hard facing diamond material at the cutting tip than found in conventional cutting elements. This results in a longer lasting element. This configuration also has an effect on the residual stresses in cutting compact. Damaging residual stresses are reduced with a cutting compact as illustrated in FIG. 3. It should be noted that the cutting element 20 of FIGS. 3 and 4 comprises three beveled surfaces configured around the cutter body 30 such that adjacent beveled surfaces do not intercept.

Figure 5:
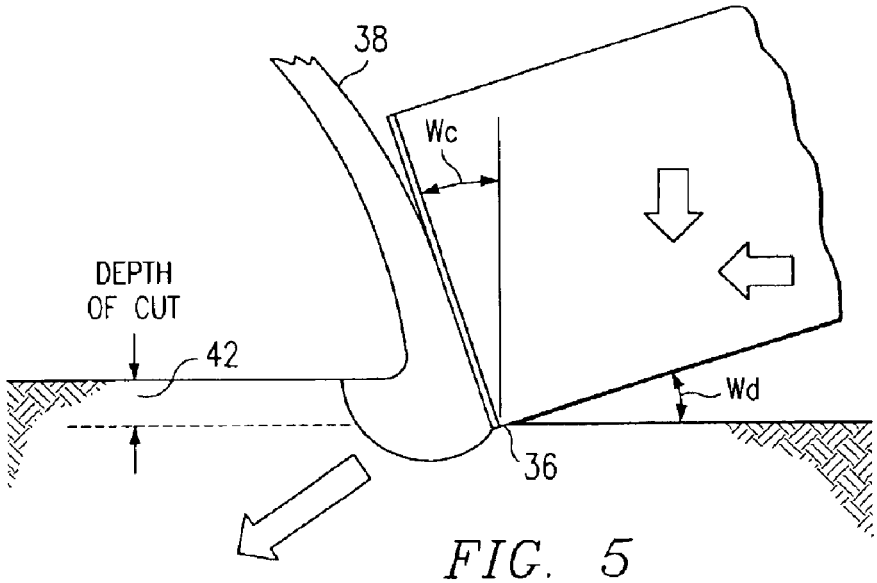
FIG. 5 is a schematic illustration of a cutting element of the present invention engaging an earth formation.

As previously stated, numerous types of drill bits have been developed for boring in earth formations. Typically, these drill bits incorporate cutting elements that utilize the same fracture mechanism in order to effect mechanical rock disintegration. Referring to FIG. 5, during boring in an earth formation, the cutting edge 36 is embedded into the formation so that the formation is in contact with a portion of the cutting surface. As the cutting surface advances against the formation, a chip 38 is formed. The chip has a first surface directed generally toward the cutting surface of the cutting element and a second surface directed generally in the direction of the cutting element travel.

Figure 6:
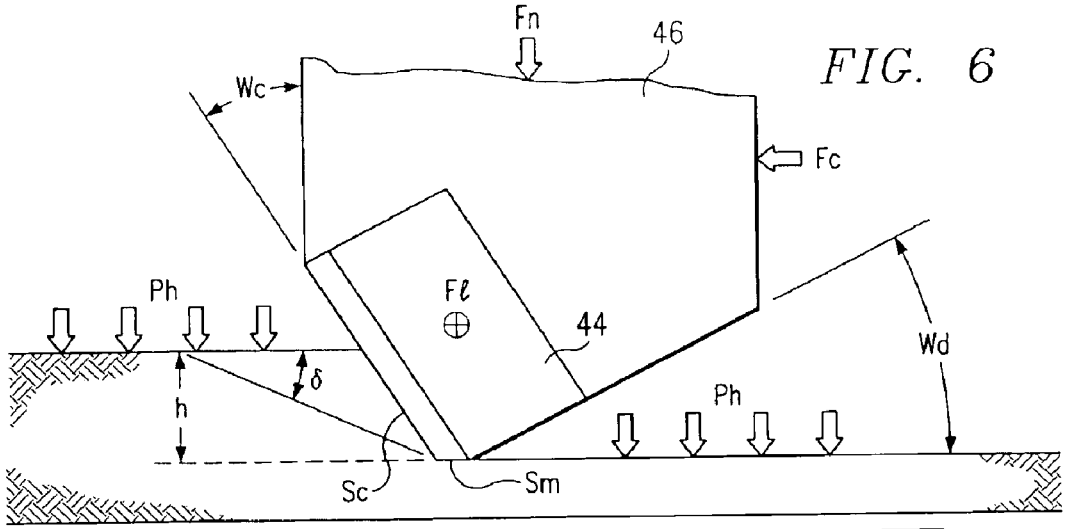
FIG. 6 is an illustration of a low contact area cutting element in a ripping action chipping mode.
Figure 7:
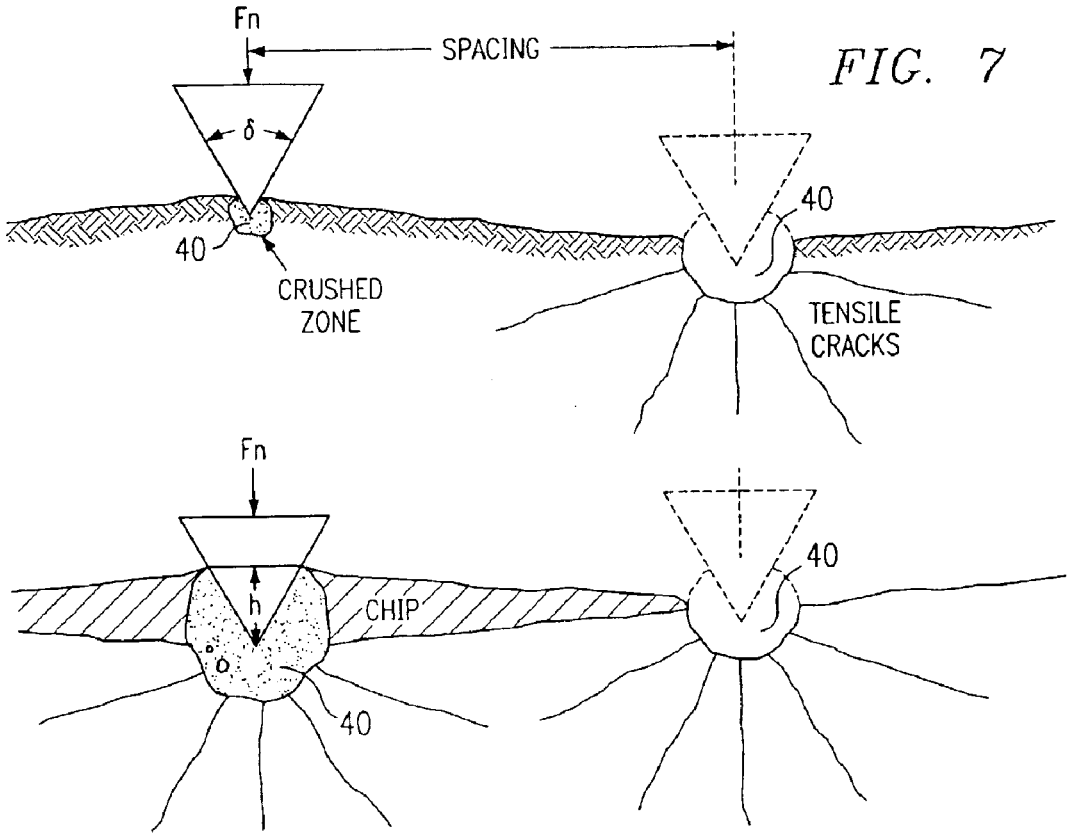
FIG. 7 illustrates a chipping mode by rock indentation where tensile stresses predominate over shear stresses.

Referring to FIGS. 6 and 7, there is illustrated the two chipping modes typically developed in the fracture mechanism encountered by cutting elements in operation of drill bits. The first chipping mode, as illustrated in FIG. 6, shows the ripping action of a cutting element into the earth formation. The normal force, Fn, is perpendicular to the speed vector as the drill bit rotates. The cutting force, Fc, of the cutting element as the drill bit rotates is parallel to the speed vector. The second chipping mode, as illustrated in FIG. 7, shows the cutting element indentation into the earth formation. In the indentation chipping mode, the cutting element penetrates the earth formation with the normal force, Fn, which is parallel to the direction of penetration of the cutting element. In both chipping modes, the action of the cutting element upon the earth formation results in a crushed zone area usually under quasi-hydrostatic stresses. This crushed zone serves to convert the forces produced by the cutting element into stress forces within the earth formation. Stresses within the crushed zone results in the propagation of fractures within the earth formation. Those fractures propagating towards the surface of the rock formation cause chips to break away, thereby resulting in advancement of the drilling process.

Again referring to FIG. 6, the first chipping mode results in earth formation fractured by shearing action rather than tensile stress failure (i.e., the values of shear stresses on the earth formation failure reach the Mohr's envelope representing a specific characteristic of the earth formation). For the second chipping mode, the tensile stresses predominate over shear stresses and consequently earth formation failure occurs under tensile loading.

It has been recognized that mechanical compression of earth formations induces some tensile stresses within the formation. An analysis of the stress formations indicates that both shear and tensile stresses exist for both chipping modes as described above. With reference to FIG. 7, the hydrostatic cushion (i.e., the crushed zone) transforms mechanical compression, which ordinarily generates compressive stresses, into tensile stress. This is commonly known as failure under indirect tension because the failure within the earth formation is predominately caused by the tensile stresses, not compressive stress. In both chipping modes, most of the energy required to fracture the earth formation is used to create the hydrostatic cushion 40 as illustrated in FIG. 7. The propagation of the fracture resulting from the hydrostatic cushion requires significantly less energy (except in the cases of soft and/or plastic rocks, where the hydrostatic cushion is almost absent).

Cutting techniques fracturing earth formation under direct tensile stress are more efficient than fracture by indirect tensile stress as it is not required to generate a hydrostatic cushion, and the tensile strength of the earth formation tends to be much lower than the compressive strength of the formation. An essential distinction between the two chipping modes resides in the difference in the magnitude of the forces between the modes and in the nature of the friction encountered by each mode. For the same depth of cut as illustrated at 42 in FIG. 5, the first chipping mode requires less force and therefore less energy than the second chipping mode.

Figure 4:
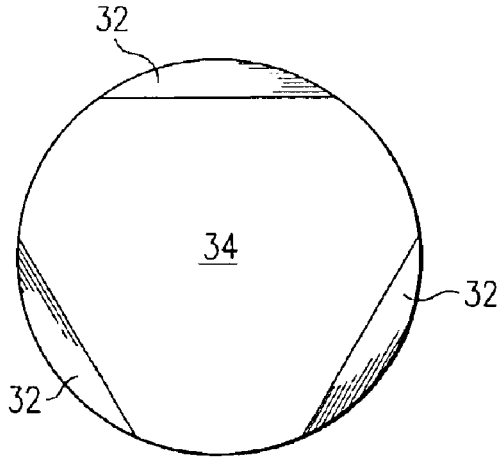
FIG. 4 is a top view of the cutting element of FIG. 3 illustrating three beveled surfaces.

Referring to FIGS. 3 and 4, the force required by the cutting element to indent the earth formation generates the normal force, and the force required to remove the cuttings from the front of the cutting element, as illustrated in FIG. 5, generates the cutting or drag force. The normal force required for indentation of an earth formation with the cutting element of FIGS. 3 and 4 is about 10 to 20 times lower than with the conventional round shape cutting element penetrating into the earth formation for the same depth of cut. Since it is difficult to disintegrate an earth formation under direct tension, the reduction of cutting forces is obtained using the cutting element of FIGS. 3 and 4 by increasing the failure of the formation under indirect tension thereby requiring significantly less energy due to the reduction of the energy required to propagate fractures toward the surface of the earth formation at the bore hole bottom. This results in deeper penetration in the earth formation for the same amount of energy as prior art cutting elements.

Referring again to FIG. 6, there is schematically illustrated a cutting element 44 conventionally mounted into a socket of a bit body 46. As the cutting edge Sc engages and cuts the earth formation, high forces are exerted on the cutting element 44 in both the normal force, Fn, direction and a horizontal force, Fc, direction. Due to the weight of the drill string bearing down on the bit and supportive cutting elements, the force Fn is exerted generally normal to the earth formation. The horizontal force Fc results from the forward travel of the cutting edge Sc and the scraping against the earth formation. As illustrated in FIG. 6, the cutting edge Sc of the cutting element 44 and the pocket supporting the cutting element are outwardly inclined in a back rake angle Wc. This results in a clearance angle Wd.

As a result of the inclination of the cutting element 44 and the rotating action of the drill bit body 46, these stresses as previously discussed result in a cutting break angle δ.

Figure 8:
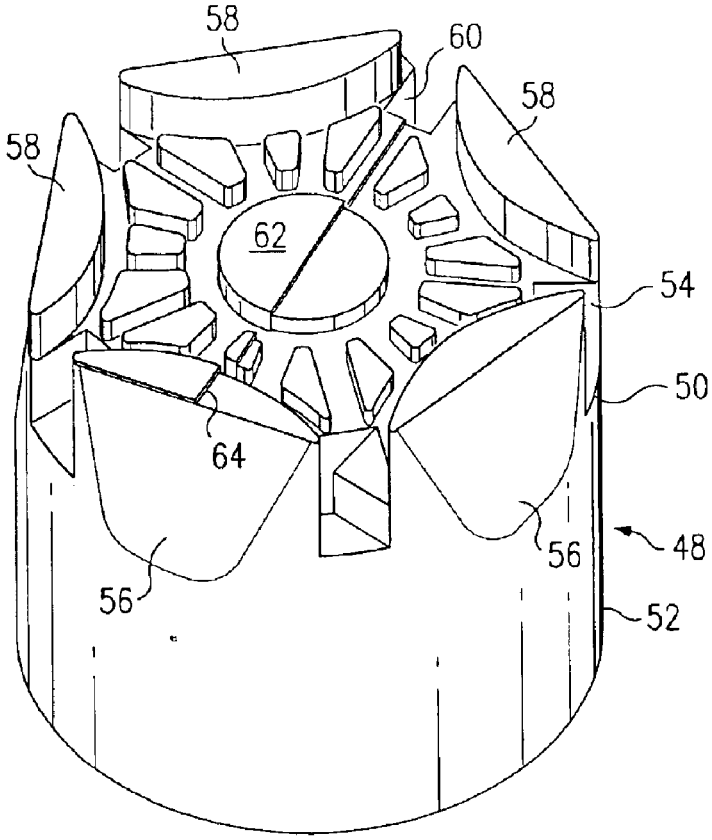
FIG. 8 is a pictorial illustration of a polygonal shaped cutting element with beveled surfaces.

Referring to FIG. 8, there is shown another embodiment of the cutting element of the present invention. As illustrated, the cutting element 48 has a cutter body 50 having a generally cylindrical based section 52 adapted for snug fit engagement in a socket of a drill bit body. Integral with the base section is a cutting section 54 having a polygonal shape configuration. The polygonal shape results from five inclined surfaces 56 extending from a top surface 58 of the cutting section. The beveled surfaces partially extend the length of the generally cylindrical cutting section 54.

As illustrated, each of the five inclined surfaces 56 do not intersect with an adjacent inclined surface, but rather each surface is separated by a channel 60. The shape and depth of the channel may vary with the use of the cutting element. Thus, the channels 60 may be semi-circular, oval, or triangular in addition to rectangular as illustrated in FIG. 8.

The top surface 62 of the cutting element 48 is patterned to have a disk shaped center surrounded by radially extending channels, the channels extending to the inclined surfaces 56.

In the embodiment of FIG. 8, the cutting element 48 comprises a diamond compact layer 64 of super hard material, such as PDC, bonded in a high pressure, high temperature press to a supporting substrate of less hard material, such as cemented tungsten carbide. However, other suitable materials may be used for the diamond compact layer 64 and the supporting substrate. The method of forming such cutting elements are well-known and no further description is deemed necessary.

Figure 9:
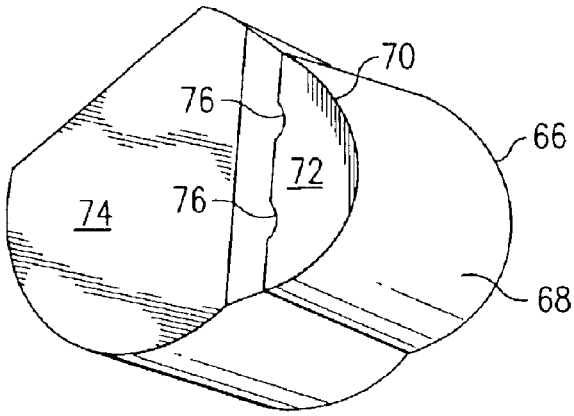
FIG. 9 is a pictorial illustration of an alternate embodiment of a shaped cutting element of the present invention.

Referring to FIG. 9, there is shown another embodiment of a cutting element in accordance with the present invention. As illustrated, the cutting element comprises a cutter body 66 having a generally cylindrical base section 68 adapted for snug fit engagement in a socket of a drill bit body. The cutter body 66 also has a generally cylindrical cutting section 70 integral with the base section 68. The cuffing section has two inclined surfaces 72 (only one shown) extending from a top surface 74 of the cutting section partially along the length of the generally cylindrical cutting section. Again, the top surface comprises a diamond compact layer of superhard material bonded to a supporting substrate of less hard material.

As illustrated in FIG. 9, the supporting substrate comprising the cutter body 66 is preformed with grooves 76 that may be radially extending. Additionally, the supporting substrate of the cutter body 66 may be provided with concentric circular grooves (not illustrated). The pattern of radially extending grooves and circular concentric grooves is more fully described in U.S. patent application Ser. No. 09/777,295, filed Feb. 5, 2001 and assigned to the assignee of the present invention. However, there are many conventional patterns of grooves in use today to adhere the diamond compact to the substrate.

As illustrated in FIGS. 3, 4, 8 and 9, the top surface of each of the illustrated embodiments has a flat configuration. However, it is within the scope of the invention that the top surface of each of the embodiments may be concave or convex without departing from the scope of the invention.

Cutting elements such as those described are generally inserted into a drag bit body at an angle, exposing the primary compact cutting surface and a portion of the cutter body. Typically, the cutting elements are inserted into the bit body in sockets by brazing so that the longitudinal axis of each cutting element is approximately perpendicular to a radius of the bit. As the bit rotates during the drilling process, the primary cutting surface makes contact with the earth formation followed by contact of the exposed portion of the cutter body. Typically, cutting elements are mounted in the bit body at an angle so that there is a negative back rake as the compact engages the earth formation, such as illustrated in FIG. 6.

The described embodiments of the invention are cutting elements which, while differing from the prior art in terms of configuration, are more or less conventional in terms of materials employed, and in particular, in that the polycrystalline diamond compact cutting layer is bonded to a substrate, that is, the cutter body usually formed from sintered tungsten carbide. The manufacturing techniques for creating the cutting elements as described herein are well-known and a further description is not deemed a requirement for an understanding of the present invention.

The overall shapes of the cutting elements illustrated and described are by way of example only, and it will be appreciated that the inclined surface of the described embodiments may be applied to any shape or size and form of cutter body.

Although the present invention has been described in connection with several embodiments, it will be appreciated by those skilled in the art that modifications, substitutions and additions may be made without departing from the scope of the invention as defined in the claims.

What is claimed is:

1. A cutting element for a drag-type drill bit, comprising:

a cutter body having a generally cylindrical base section adapted for snug-fitting engagement in a socket of a drill bit body;

the cutter body having a generally cylindrical mid-portion disposed between a cutting section and the base section;

the cutter body having a plurality of inclined surfaces extending from the mid-portion to a top surface of the cutting section; and a plurality of channels formed in the top surface of the cutting section between adjacent inclined surfaces.

2. The cutting element as in claim 1 wherein the cutter body comprises a sintered tungsten carbide, and the top surface comprises a layer of super-hard material.

3. The cutting element of claim 1, wherein the inclined surfaces are configured such that a top view of the cutter body comprises a generally polygonal shape.

4. The cutting element of claim 1, wherein a top surface of the cutter body comprises a generally planar surface.

5. The cuffing element of claim 1, wherein a top surface of the cutter body comprises a generally convex surface.

6. The cutting element of claim 1, wherein a top surface of the cutter body comprises a generally concave surface.

7. The cutting element of claim 1, wherein the cutter body comprises a sintered tungsten carbide.

8. A cutting element comprising:

a cutter body having a generally cylindrical base section adapted for snug-fitting engagement in a socket of a drill bit body;

the cutter body having a generally cylindrical cutting section integral with the base section, the cutting section having a plurality of inclined surfaces extending from a top surface of the cutting section partially along the length of the generally cylindrical cutting section; and a channel formed in the top surface of the cutting section between adjacent inclined surfaces; and the cutting section has a polygonal shape at the top surface.

9. The cutting surface as in claim 8 wherein the inclined surfaces are spaced apart at the top surface.

10. The cutting element as in claim 9 wherein the channel formed in the top surface of the cutting section between adjacent inclined surfaces comprises a separation between adjacent inclined surfaces.

11. A cutting element for a drag-type drill bit, comprising:

a cutter body having a base section at one end, a cutting section at another end opposite the base section, and a generally cylindrical mid-portion disposed between the base section and the cutting section;

a plurality of inclined surfaces each extending from the mid-portion to the cutting section;

each of the plurality of inclined surface being separated from adjacent ones of the plurality of inclined surfaces by a plurality of channels formed in the cutting section; and the inclined surfaces being configured such that a top view of the cutter body comprises a generally polygonal shape.

12. The cutting element of claim 11, further comprising a layer of super-hard material formed integrally to portions of a top surface of the cutting section.

13. The cutting element as in claim 12 wherein the layer of super-hard material comprises a polycrystalline diamond.

14. The cutting element of claim 11, further comprising a recessed portion formed within a top surface of the cutting section, the recessed portion including a disk shaped center.

15. The cuffing element of claim 14, further comprising a plurality of radially extending channels disposed upon the recessed portion and around the disk shaped center.

16. The cutting element of claim 15, wherein the radially extending channels extend from a first area adjacent the disk shaped center, to a second area adjacent the inclined surfaces.

17. The cutting element as in claim 11 wherein a top surface of the cutting element comprises a generally planar surface.

18. The cutting element as in claim 11 wherein a top surface of the cutting element comprises a generally convex surface.

19. The cutting element as in claim 11 wherein a top surface of the cutting element comprises a generally concave surface.

20. The cutting surface as in claim 11 wherein the cutter body comprises a sintered tungsten carbide.

* * * * *